US006860035B2

(12) United States Patent
Girard

(10) Patent No.: US 6,860,035 B2
(45) Date of Patent: Mar. 1, 2005

(54) TIGHTENING DEVICE FOR FOOTWEAR, AND AN ARTICLE OF FOOTWEAR INCORPORATING SUCH TIGHTENING DEVICE

(75) Inventor: François Girard, Veyrier Du Lac (FR)

(73) Assignee: Salomon S.A., Metz-Tessy (FR)

( * ) Notice: Subject to any disclaimer, the term of this patent is extended or adjusted under 35 U.S.C. 154(b) by 525 days.

(21) Appl. No.: 09/908,938

(22) Filed: Jul. 20, 2001

(65) Prior Publication Data

US 2002/0007570 A1 Jan. 24, 2002

(30) Foreign Application Priority Data

Jul. 21, 2000 (FR) ..... 00 09800

(51) Int. Cl.[7] ..... A43C 11/00; A43B 23/00; A43B 7/14

(52) U.S. Cl. ..... 36/50.1; 36/117.6; 36/88; 36/93; 36/45

(58) Field of Search ..... 36/50.1, 88, 97, 36/117.6, 117.7, 117.9, 93, 99, 11.5, 45, 142, 143, 144, 54

(56) References Cited

U.S. PATENT DOCUMENTS

| | | | | | |
|---|---|---|---|---|---|
| 2,530,637 | A | | 11/1950 | Taylor | 36/8.5 |
| 3,308,829 | A | * | 3/1967 | Edwards | 36/142 |
| 4,557,061 | A | * | 12/1985 | Graillat et al. | 36/117.9 |
| 4,638,578 | A | * | 1/1987 | Eiteljorg, II | 24/68 SK |
| 4,901,451 | A | * | 2/1990 | Cumin | 36/170 |
| 5,105,565 | A | * | 4/1992 | Barret | 36/117.2 |
| 5,228,219 | A | * | 7/1993 | Tonel | 36/50.1 |
| 5,337,493 | A | | 8/1994 | Hill | 36/54 |
| 5,483,757 | A | * | 1/1996 | Frykberg | 36/101 |

FOREIGN PATENT DOCUMENTS

| | | |
|---|---|---|
| DE | 4229036 | 3/1994 |
| EP | 0521287 | 1/1993 |
| EP | 0647414 | 4/1995 |
| FR | 2626447 | 8/1989 |
| FR | 2694167 | 2/1994 |
| GB | 2256574 | 12/1992 |

* cited by examiner

*Primary Examiner*—M. D. Patterson
(74) *Attorney, Agent, or Firm*—Greenblum & Bernstein, P.L.C.

(57) ABSTRACT

A tightening device adapted to equip an article of footwear, which makes it possible to hold the foot laterally, while distributing on the foot the pressure generated by the tightening device. The tightening device includes an upper flap that partially covers a lower flap. The flaps hold the foot by the tightening device which includes at least one anchor positioned on each of the flaps. The upper flap is more flexible than the lower flap.

40 Claims, 8 Drawing Sheets

TIGHTENING DEVICE FOR FOOTWEAR, AND AN ARTICLE OF FOOTWEAR INCORPORATING SUCH TIGHTENING DEVICE

CROSS-REFERENCE TO RELATED APPLICATIONS

This application is based upon French Patent Application No. 00 09800, filed Jul. 21, 2000, the disclosure of which is hereby incorporated by reference thereto in its entirety, and the priority of which is claimed under 35 U.S.C. §119.

BACKGROUND OF THE INVENTION

1. Field of the Invention

The present invention relates to a tightening device adapted to equip an article of footwear, such as a shoe, a boot, or a sandal, adapted in particular, but in a non-limiting manner, to the practice of sports. The invention specifies elements related to elements of the tightening device on which the tightening mechanism itself is fixed.

2. Description of Background and Relevant Information

In the prior art, the arrangement for tightening a shoe or boot is often fixed directly on the upper, in the area of the quarters adapted to be brought closer together. In order that the tightening arrangement can hold the foot properly, the upper must be as flexible as possible. If it is too flexible, the upper can no longer distribute the tightening pressure which can prove painful for the foot. Conversely, a rigid upper makes it possible to properly distribute the tightening pressure, but at the expense of the comfort and holding of the foot, which must be compensated for by the use of an inner liner that fills the space left between the upper and the foot.

The document EP 521 287 describes an internal tightening applied to a mountain walking shoe. The tightening device is more precise than the previous device, because it is closer to the foot. However, this internal tightening, which is obtained by flexible elements, retains the aforementioned disadvantages which result from the use of a flexible structure.

The document FR 2 694 167 describes an external tightening device for a mountain hiking boot which includes a rigid flap positioned on the lateral portion, in the area of the instep, on the outer side of the boot. This flap makes it possible to maintain the foot applied against the medial side of the boot upper, due to the tightening arrangement.

However, this device has a discontinuity between the upper end of the rigid flap and the most flexible upper located on the other lateral portion of the foot. This discontinuity, on the top of the instep, can prove very painful for the user, because the tightening device does not make it possible to distribute the tightening pressure. Indeed, the tightening system is anchored directly on the end of the rigid flap.

The document DE 42 29 036 describes a mountain hiking boot in which the two quarters of the upper have an area of overlapping, in particular in the area of the instep, and are provided with a lace tightening system. This device makes it possible to simplify the opening of the boot while ensuring that the latter is impervious. However, the upper does not make it possible to distribute the tightening pressure comfortably on the foot, since it has a substantially identical flexibility on the two quarters. Moreover, the two quarters of the upper deform substantially in a symmetrical manner to encircle the foot, and the tightening device therefore does not apply the foot against a predetermined quarter of the upper.

SUMMARY OF THE INVENTION

An object of the present invention is to propose an improved tightening device resolving the aforementioned disadvantages of the prior art.

One of the objects of the present invention is to propose a tightening device adapted to equip an article of footwear, which makes it possible to maintain the foot applied against one of the predetermined sides of the footwear, while ensuring that the pressure generated by the tightening system is distributed on the foot.

Another object of the invention is to propose a tightening device that improves the torsional rigidity of the footwear while respecting the bending of the footwear as much as possible.

To achieve these objects, the tightening device includes a lower flap and an upper flap having an overlapping zone which partially covers the lower flap. To properly distribute the pressures generated by a tightening device having at least one anchor on each of the flaps, the upper flap is more flexible than the lower flap. Similarly, the anchor located in the area of the upper flap is positioned in the overlapping zone.

In the first embodiment, the flaps constitute the upper of the footwear.

In a second embodiment, the flaps, which are positioned outside the footwear upper, form an external tightening device.

In a third embodiment, the flaps, which are positioned inside the footwear upper, form an internal tightening device.

In a fourth embodiment, the upper flap is integral with the footwear upper.

BRIEF DESCRIPTION OF THE DRAWINGS

The invention will be better understood and other advantages thereof will become apparent from the description that follows, with reference to the annexed schematic drawings. The description illustrates, by way of non-limiting examples, certain preferred embodiments.

DETAILED DESCRIPTION OF THE INVENTION

Figure 1:
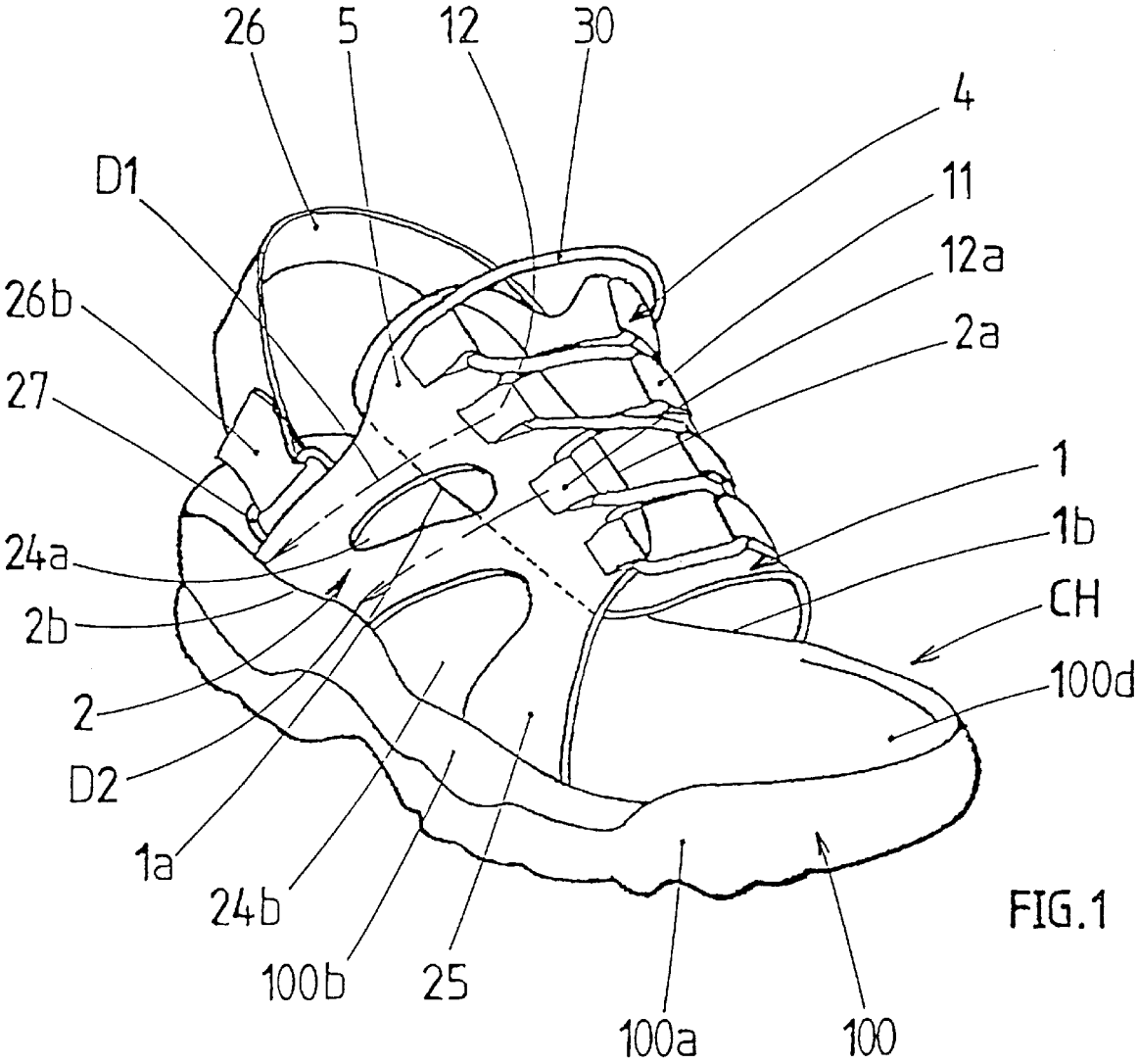
FIG. 1 shows a perspective front view of a sandal equipped with the tightening device according to the first embodiment.

In FIG. 1 the footwear CH shown is a sandal. The sandal does not include an entire upper, but the foot is held on the sole 100 directly by the tightening device according to the present invention. This tightening device holds the foot vertically and laterally by means of flaps 1, 2.

In the preferred embodiment shown, the tightening device is completed by a rear holding in the heel area. However, this complementary holding component is not indispensable, the footwear thus obtained then being a mule-type sandal that leaves the heel exposed. The rear holding here is constituted of a strap 26 that is fixed to one of the flaps 1, and which passes in a guide 27 fixed on the other flap 2. The strap 26*b*, which includes a fixing mechanism, of the self-gripping type in particular (such as a hook and loop fastener), makes it possible to fix the return 26*b* on the strap 26.

The tightening device has a lower flap 1 and an upper flap 2 arranged on each of the lateral and medial sides of the footwear CH. The upper flap 2 partially covers the lower flap 1 in the area of an overlapping zone 5.

In this first embodiment, the flaps 1, 2, directly constitute the upper of the footwear CH, and are fixed on the sole 100. Thus, the lower flap 1 includes, in the area of the lower end 1*b*, fixing means that are adapted to affix the flap 1 to the sole 100. Similarly, the upper flap 2 includes, in the area of the lower end 2*b*, fixing means that are adapted to affix the upper flap 2 to the sole 100. The sole 100 currently shown includes a wear sole 100*a* overlaid by an intermediate shock absorbing sole 100*b*, the means, of the adhesive type in particular, for fixing the flaps 1, 2 make it possible to fix the flaps 1, 2, on the intermediate shock-absorbing sole lob. These fixing means can be advantageously covered by an insole, i.e., a comfort sole 100*d*, especially made of leather, adapted to be in contact with the foot and to cover the top of the sole 100.

Figure 1A:
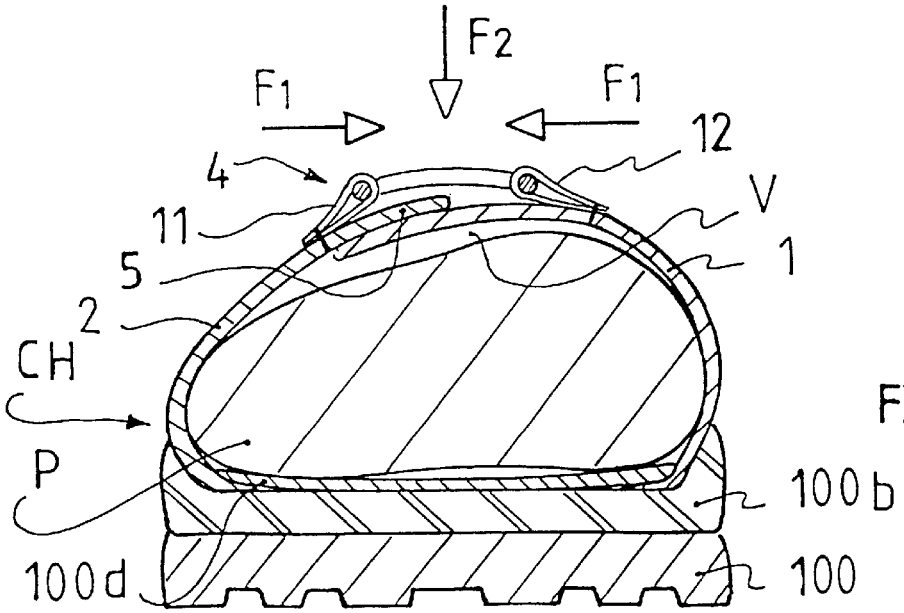
FIG. 1A schematically shows a transverse cross-section of the boot shown in FIG. 1, along a cross-sectional direction D1 referenced in FIG. 1.

The tightening device also includes a tightening mechanism 4 that includes at least one anchor 11, 12 positioned on each of the flaps 1, 2. This tightening mechanism makes it possible to bring the two flaps 1, 2 closer together so as to encircle the foot against the sole 100. The tightening mechanism 4 currently shown is of the lacing type including a link 30 that alternately connects the anchors 11,12 which, here, are lace guides fixed to the flaps 1, 2 and which, by enabling the link 30 to slide, transmit the tightening forces to the flaps 1, 2. The tightening mechanism 4 also includes a blocking mechanism (not shown) which can be a knot or a blocker mounted on the link 30, making it possible to maintain the tension in the link 30. The anchors 12, 12*a*, located in the area of the upper flap 2, are positioned in the overlapping zone 5. This overlapping zone 5 is defined by the overlapping of the flaps 1, 2 when the tightening device is closed around a foot. It extends from the upper end 2*a* of the flap 2 toward the sole 100. Moreover, the anchors 11, located on the lower flap 1, are positioned outside the projection of the overlapping zone 5 on the flap 1. That is, as seen in FIGS. 1 and 1A, the anchors attached to the lower flap are spaced from the overlapping zone 5. Thus, regardless of the position, especially open or closed position, of the tightening device during the various phases of use, the end 2*a* of the upper flap 2 does not cover the anchors 11 that are located on the lower flap 1.

To properly hold the foot in the footwear CH, the flaps 1, 2 are advantageously arranged in the area of the instep so as to encircle this portion of the foot. As shown in FIGS. 1 and 1A, for example, at least the lower flap 1 extends over the uppermost portion of the area of the instep. Similarly, it is preferable that the flaps 1, 2, do not extend in the area of the metatarsophalangeal joint and in the area of the malleolus of the ankle joint in order not to hinder the bending of these joints. One solution among others consists of positioning the flaps 1, 2 between the two aforementioned zones of the foot, i.e., rearward of the metatarsophalangeal joint and forward of the malleolus of the ankle joint. Respecting this constructional arrangement makes it possible to guarantee a maximum comfort of the foot by respecting the biomechanics of the foot and of the ankle joint.

The arrangement of the flaps in the area of the base of the leg, above the malleoli of the ankle joint, is consistent with the invention. In this case, the two flaps are also joined behind the leg and are affixed to one another in the area of the calf muscle or behind the ankle.

In FIG. 1*a*, which shows a transverse cross-section of the first embodiment, the upper flap 2 distinguishes over the lower flap 1 in particular by the fact that the upper flap 2 is more flexible than the lower flap 1. This asymmetry in the flexibility makes it possible, among other things, to predetermine a reference flap, in this case the most rigid flap which, here, is the lower flap 1, against which the foot is going to be immobilized by the present tightening device. Indeed, under the action of the tightening mechanism 4 acting on the two flaps 1, 2, via the anchors 11, 12, the upper flap 2 is going to deform more than the lower flap 1, since it is the most flexible. Therefore, the upper flap 2 is going to apply itself against the foot and possibly displace the foot laterally toward the lower flap 1 until the foot takes support against the lower flap 1.

Furthermore, the rigidity of the lower flap 1 also makes it possible to better distribute on the foot the pressure generated by the tightening device 4. Indeed, the tightening mechanism 4 generates, in a known fashion, a primary force F1 which tends to bring the two flaps 1, 2 closer together, and to stabilize the foot laterally. But this force F1 is invariably accompanied by a secondary force F2 which is perpendicular to the primary force F1, and which tends to flatten the foot P on the sole (100, 100*b*). In the cross-section shown in FIG. 1A, the primary force F1 is substantially horizontal and oriented transversely with respect to the article of footwear CH, whereas the secondary force F2 is substantially vertical and oriented downward. In addition, since the tightening mechanism 4 is located on the overlapping zone 5, in the area of the upper flap 2, the forces (F1, F2) are applied directly on the lower flap 1. Thus, the rigidity of the lower flap 1 makes it possible to control the bending of the flap 1, and therefore to limit the downward deformation that is induced by the secondary force F2. Respecting this constructional arrangement makes it possible to obtain a powerful lateral holding of the foot P against the lower flap 1 and while not generating any uncomfortable excess pressure on the top of the foot. Indeed, the rigidity of the lower flap 1 can be defined advantageously such that, under the action of the tightening system 4, the flap leaves an empty space V on the top of the foot, or at least substantially brushes the top of the foot P without exerting any excess pressure.

In the preferred embodiment shown in FIG. 1, the flexibility of the upper flap 2 is obtained by recesses 24*a*, 24*b* on the upper flap 2, which are shown as through holes in the flap in FIG. 1, which make it possible to soften and ventilate this flap 2. The upper flap 2 can advantageously include at least one recess 24*b* that opens out on the sole 100, and which demarcates a front arm 25 in the flap 2. The arm 25 is fixed on the sole 100 in the area of the metatarsophalangel joint in order to provide a good holding of the foot. The upper flap 2 can also include at least one recess 24*a* that remains enclosed in the flap 2. This recess 24*a* advantageously has an elongated shape whose large dimension is oriented substantially along the curvilinear direction D1, D2, perpendicular to the upper edge of the foot, and connecting the upper edge of the foot to the sole 100 in the area of the instep. Similarly, the recess 24*a* is advantageously positioned between two curvilinear directions D1, D2 which pass by two constituent anchors 12, 12*a* located on the upper flap 2. Thus, the holding force exerted by the link 30 on the anchors 12, 12*a* is properly transmitted directly to the sole 100, without the recess 24*a* changing the power of the tightening device.

The presence of the recesses 24*a*, 24*b* in the upper flap 2 also makes it possible to soften the flap 2, and therefore to use the same material for the upper flap 2 and the lower flap 1. These recesses 24*a*, 24*b* can be combined with other measures, described subsequently, making it possible to soften the upper flap 2, such as the use of a more flexible and thinner material for the upper flap 2. Any combination of the recesses 24*a*, 24*b* with other means remain consistent with the invention, as long as the upper flap 2 is more flexible than the lower flap 1.

It can also be advantageous to provide the article of footwear CH with a comfort element, in the area of the edge 1*a* of the lower flap 1, which is located at the end of the overlapping zone 5. This comfort element can be an inner lining positioned locally in the area of the edge 1*a* of the flap 1, or in particular an inner sock positioned beneath the flaps 1, 2 and connected on both sides to the flaps 1, 2 or to the sole 100. This comfort element (not shown) can be made in particular of neoprene or of elastic fabric.

Figure 2:
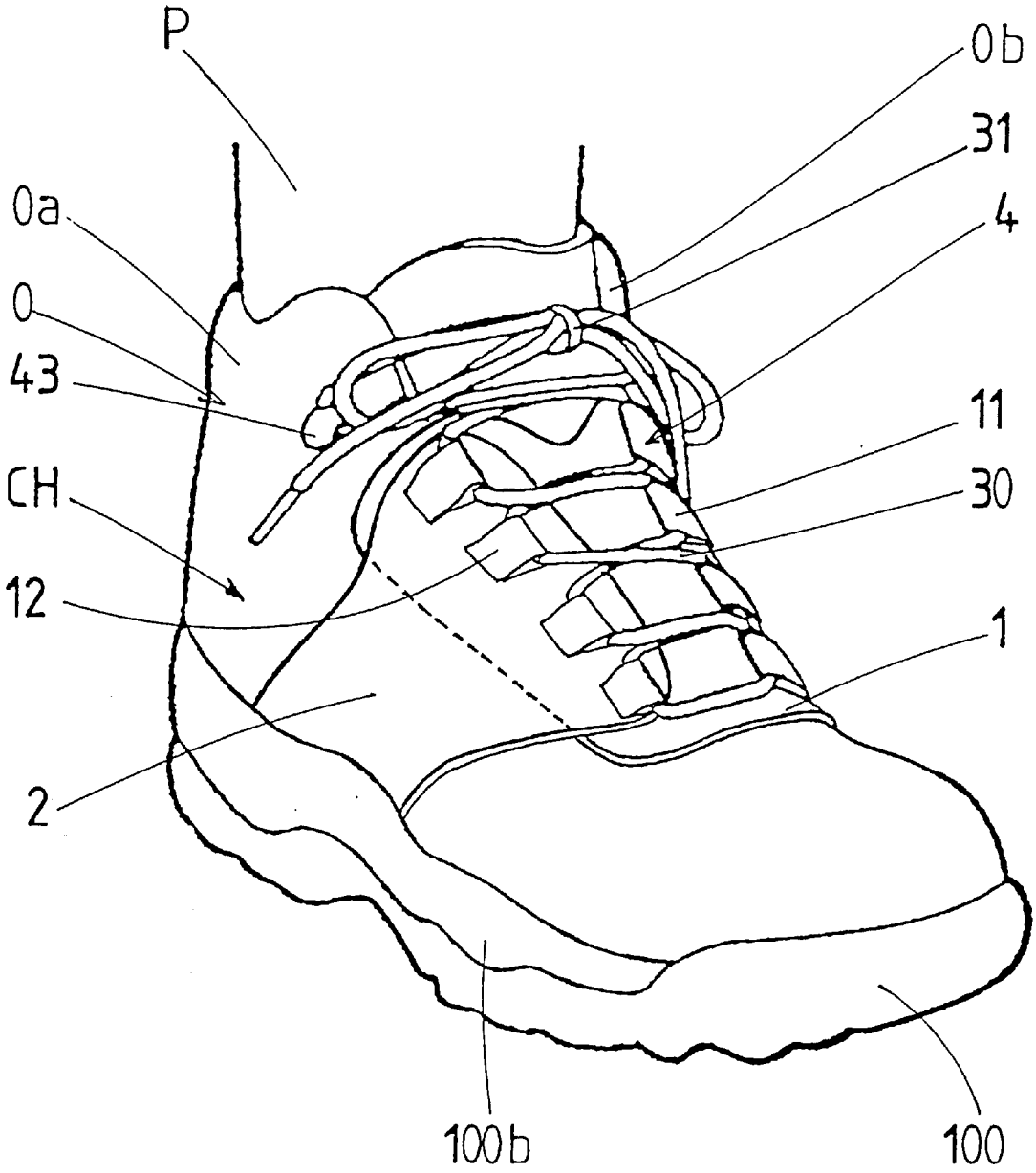
FIG. 2 shows a perspective front view of a sports boot equipped with the tightening device, in the closed position, according to the second embodiment.

In FIG. 2 the footwear CH shown is a sports boot having a mid-height upper O used in particular for walking. The article of footwear CH includes a sole 100 overlaid by an upper O which is in turn overlaid by the flaps 1, 2 of the tightening device. Since the lower flap 1 and upper flap 2 are positioned outside the upper O, they constitute, together with the tightening mechanism 4, a tightening device outside the article of footwear CH. However, the observations regarding the tightening device described in the previous embodiment remain applicable to the present embodiment.

Because ventilation is not primordial for this type of footwear CH, since the upper O is positioned between the flaps 1, 2 and the foot P, the relative flexibility of the upper flap 2, with respect to the lower flap 1, is obtained, for example, by the use of a material that is thinner for the upper flap 2 than for the lower flap 1. Indeed, for an identical material, the thinner the flap 2, the more flexible the upper flap 2 will be. The advantages obtained by the flexibility of the upper flap 2 with respect to the lower flap 1 remain identical to those described in the previous embodiment.

In the preferred embodiment shown in FIG. 2, the tightening mechanism 4, which is positioned on the flaps 1, 2, also extends over the upper O in the area of the ankle joint. Indeed, the upper O includes at least one lace guide 43 arranged substantially symmetrically on each of its two lateral and medial surfaces Oa, Ob, and arranged higher and further to the rear in relation to the lace guides 11, 12, arranged on the flaps 1, 2. Thus, the lace 30 passes in the anchors 11, 12, positioned on the flaps 1, 2, by maintaining the foot in the area of the instep, then passes in the guides 43 before being blocked by a blocking mechanism 31, such as a knot. Similarly, the flaps 1, 2 are fixed to the sole 100 in a known fashion, between the upper O and the sole 100, possibly in the area of the shock-absorbing sole 100b. Thus, the tightening is more efficient due to the complete independence between the deformation of the upper O with respect to the coming together of the flaps 1, 2.

Given the asymmetry of the foot, it is the flap arranged on the lateral portion, i.e., on the outer side, that is the most biased in deformation in order to assume the shape of the foot in the area of the instep. However, since the flaps 1, 2 are fixed on the sole 100, 100*b*, they cannot pivot like a hinge, but can only deform in bending. This is why the lower flap 1, which is rigid, is advantageously positioned on the medial, i.e., internal, side of the article of footwear CH, and the upper flap 2, which is flexible, is arranged on the lateral, i.e., external, side of the footwear CH.

Depending on the desired effect, an inverse arrangement can be adopted, with the more rigid lower flap 1 being arranged on the lateral side of the foot as specified in document FR 2 694 167. However, as specified in that document, the lower flap 1 can be advantageously fixed on the upper O by fixing means, such as stitched seams, which enable a hinge-type pivoting of the flap. These seams can be placed slightly above the top of the sole 100, in the area where the largest curvature of the foot on its outer surface is observed, in order to better adapt to the foot morphology.

The upper O is reinforced in its mechanical structure by the flaps 1, 2 which are external. This improvement of the mechanical characteristics of the article of footwear CH enables the latter to better resist the torsional deformations. This improvement is reinforced by the overlapping geometry of the flaps 1, 2 which create, together with the sole 100, a structure that is almost closed and very resistant to the torsional forces.

Figure 3:
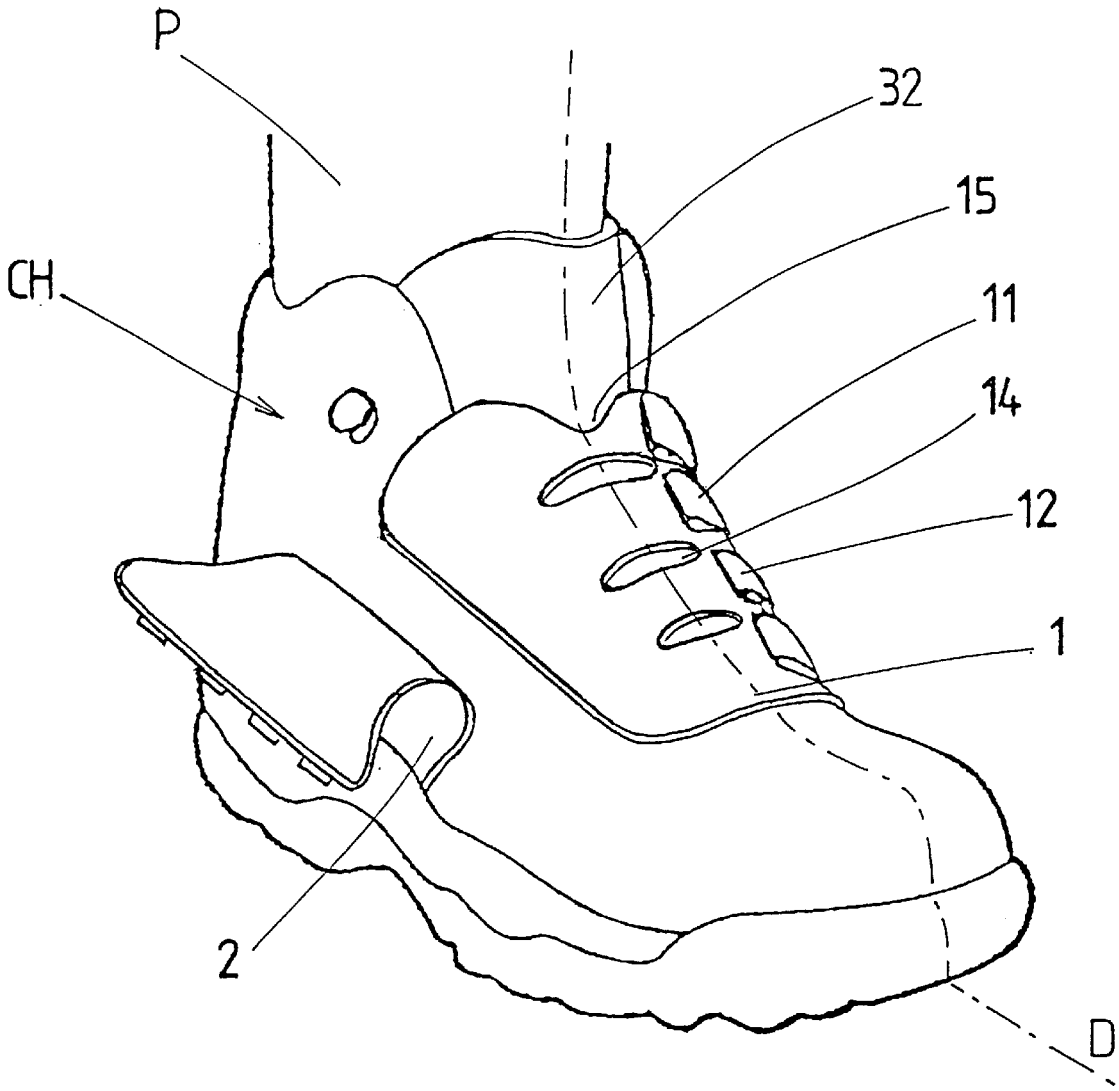
FIG. 3 shows a perspective front view of a sports boot, but whose tightening device is in the open position and consistent with a first alternative of the second embodiment.

FIG. 3 shows a variation of the previously described article of footwear CH, but which is shown with the tightening device open and not equipped with a tightening mechanism in order to clearly illustrate the elements provided by this variation. The upper flap 2 is currently illustrated in the overturned position.

In this variation, the flexibility of the upper flap 2 is obtained by the use, for the upper flap 2, of one or more materials that are more flexible than those used for the lower flap 1. By way of non-limiting examples, the lower flap 1 can be made of a plastic material, especially thermoformed, such as polypropylene, ABS, polyethylene, about 0.5–2.5 millimeters thick, whereas the upper flap 2 is made of leather or fabric. Similarly, if the lower flap 1 is made of leather, then the upper flap can be made of fabric.

The lower flap 1 can advantageously include specific arrangements located substantially on the longitudinal axis D of the foot, in order to hinder as little as possible the flexibility of the foot and ankle joint in forward bending. The lower flap 1 can therefore include a scallop 15, located on its upper portion and substantially along the longitudinal axis D of the foot, which makes it possible, during the bending of the ankle, to reserve a space for the tibial bone. Similarly, the article of footwear CH can be advantageously provided with a padded and comfortable tongue 32 so as to improve the comfort in the area of the scallop 15. The lower flap 1 can also include at least one recess 14 arranged substantially perpendicular to the longitudinal axis D of the foot, especially on the top of the foot. This recess 14, which makes it possible to soften the lower flap 1 in forward bending, can be advantageously positioned between two anchors 11, 12 of the lower flap 1. Respecting this constructional arrangement makes it possible to position the crossing of the lace substantially on the recess 14, which prevents the lace from stiffening the lower flap in bending.

Figure 4:
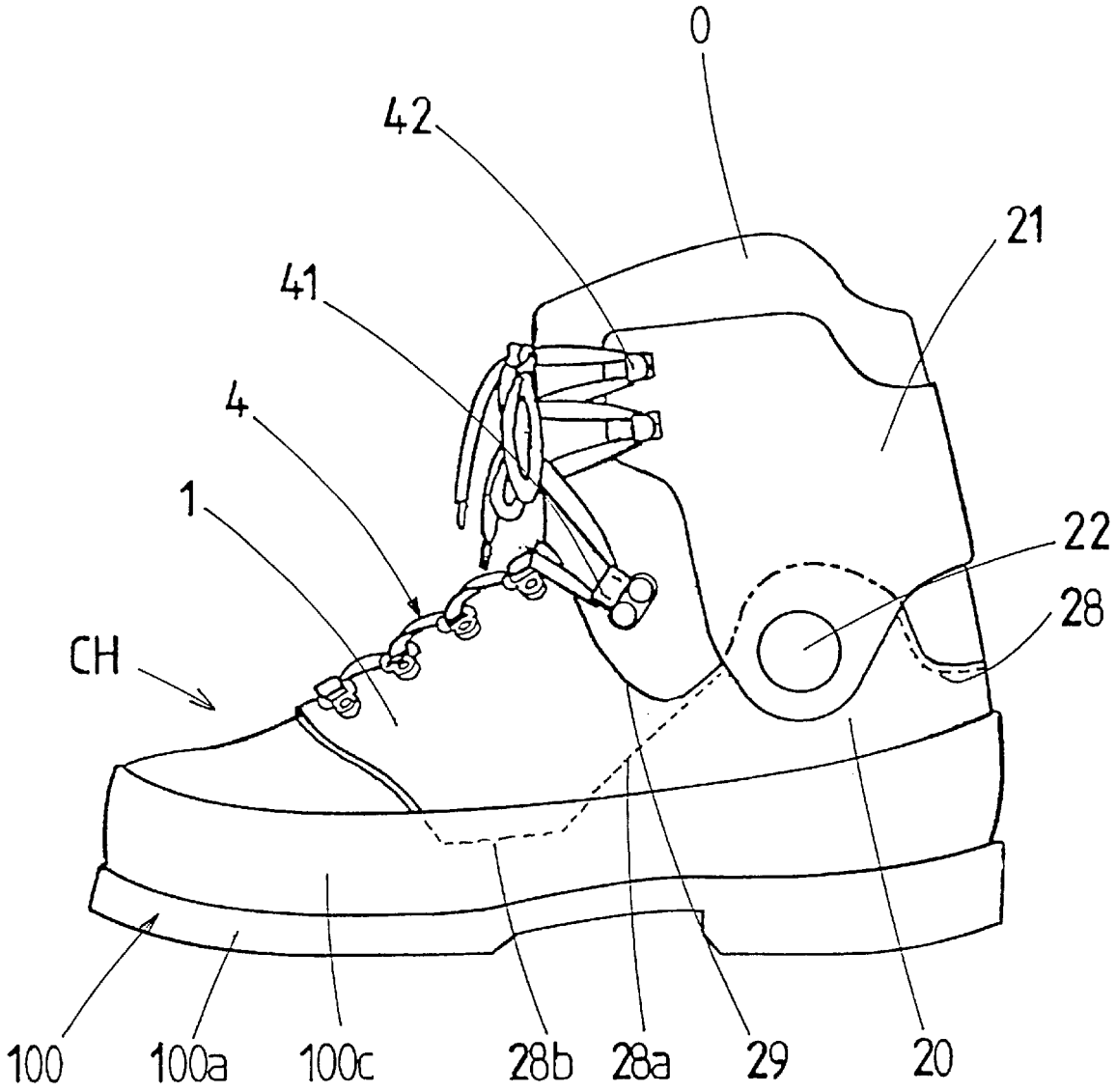
FIG. 4 shows a side view of a mountain walking shoe equipped with the tightening device according to a second alternative of the second embodiment.

FIG. 4 shows an article of footwear CH provided with a substantially high upper O covering the ankle joint and the lower leg. This article of footwear CH is more particularly adapted to mountain hiking, paragliding, walking on ice, but it can also equip a chassis adapted to in-line roller skating or ice skating.

The article of footwear CH includes a sole 100 having a wear sole 100*a* overlaid by a protective band 100*c* which rises vertically along the upper O so as to protect it from impacts during walking, especially on stones. The lower flap 1 is positioned on the medial side of the footwear CH. The lower 1 and upper 2 flaps can be fixed to the sole 100 as described previously, or they can be fixed to the upper O on the interior of the protective band 100*c*, by fixing means 28*b* such as stitched seams. To perfect the protection against stones, the footwear CH is equipped with a heel stiffener 20 which preferably surrounds the ankle and the heel, and which extends upwardly along the upper O above the protective band 100*c*. This heel stiffener 20, made of a rigid or semi-rigid material, in particular plastic, is fixed to the upper O by appropriate means such as stitched seams 28 positioned preferably along the periphery of the heel stiffener 20.

On the article of footwear CH shown in FIG. 4, the lower flap 1 extends rearwardly by merging with the heel stiffener 20. The flap 1 and the heel stiffener 20 therefore form a unitary piece. The lower flap 1 is also fixed to the upper O by a seam 28*a* that extends preferably along a direction substantially parallel to the upper edge of the instep, and which connects the seam 28*b* to the seam 28. Thus, the lower flap 1 is separated from the upper O over a substantially constant width defined by the seams 28*a*, 28*b*. This enables an efficient tightening as described previously in FIG. 2.

Moreover, the tightening mechanism 4 is extended toward the top of the article of footwear CH, outside the lower flap 1, by a lace guide 41 arranged substantially in the area of the ankle joint which makes it possible to firmly hold the foot in the article of footwear CH by a tightening of the heel perimeter. In addition, the lower flap 1 includes a recess 29 complementary of the lace guide 41 that advantageously clears the upper O in the area of the zone of the ankle joint.

Similarly, the tightening mechanism 4 can advantageously extend upward by passing in lace guides 42 that are positioned on a collar 21. This rigid collar 21 is pivotally mounted on the heel stiffener 20 via a connecting mechanism such as a rivet 22, and is adapted to stiffen the ankle.

Figure 5:
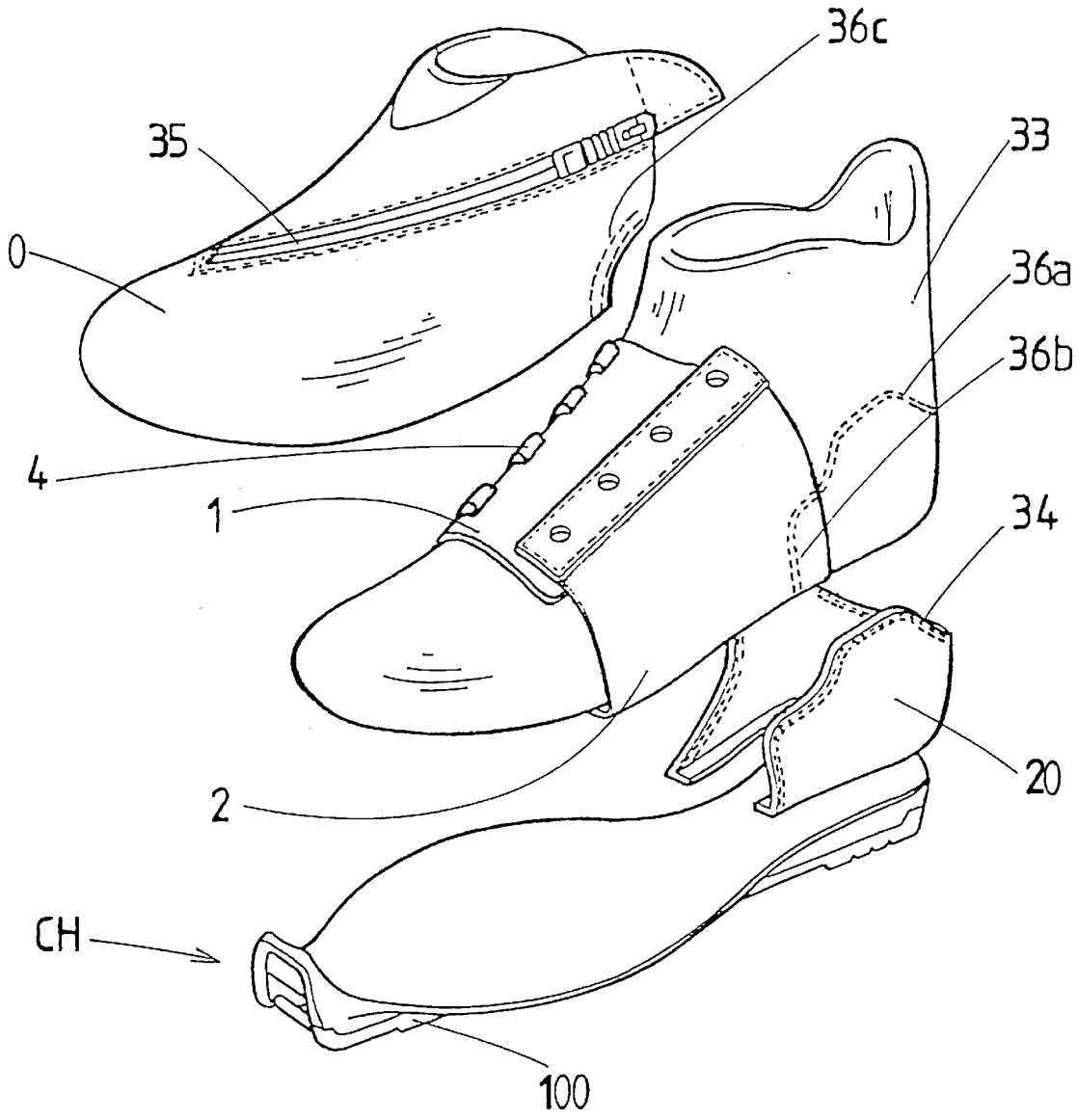
FIG. 5 schematically shows an exploded perspective front view of a cross-country ski boot equipped with the tightening device according to the third embodiment.

FIG. 5 shows an article of footwear CH adapted to cross-country skiing, and in particular, but in a non-limiting manner, to the alternate step. The footwear CH is shown in an exploded perspective view on the outer side, in which the link of the tightening mechanism 4 is not shown for reasons of clarity.

In this embodiment, the article of footwear includes an upper O adapted in particular to protect the foot from the snow and the cold, which covers the lower flap 1 and the upper flap 2, thus constituting a tightening device inside the article of footwear CH. For added comfort, the foot is positioned within a comfort envelope 33 and is held by the flaps 1 and 2 which are outside the comfort envelope 33, and which are fixed on the sole 100. The comfort envelope 33 can be removable or fixed to the sole 100 during the assembly of the article of footwear CH. The tightening device, constituted by the flaps 1, 2, is consistent with the previously described constructional details.

The article of footwear CH is also provided with a heel stiffener 20 that surrounds the heel and is fixed to the sole 100 while being positioned outside the article of footwear CH. The heel stiffener 20 includes appropriate fixing means, such as seams 34, which make it possible to fix the heel stiffener 20 on the comfort sock 33 in the area of the stitching zone 36*a*, and which make it possible to fix the heel stiffener 20 on the upper flap 2 in the area of the stitching zone 36*b*. The seam 34 also maintains the upper O, in the area of the stitching zone 36*c*, inserted between the upper flap 2, in the area of the stitching zone 36*b* and the heel stiffener 20. This inserted holding is obtained in the area of the stitching zone 36*b* of the upper flap 2.

During the alternate step, the article of footwear CH serves to guide the ski laterally, but also to lift the ski during the advancing phase of the leg. Thus, the weight of the ski is recovered by the top of the foot. However, in the area of the instep, the top of the foot is much more sensitive on its lateral, i.e., outer side. This is why the lower flap 1 can be advantageously positioned on the inner side of the foot in order to constitute a rigid support surface making it possible to recover the weight of the ski, and the upper flap 2, which is flexible, can be positioned on the lateral side for the comfort of the foot.

Figure 6:
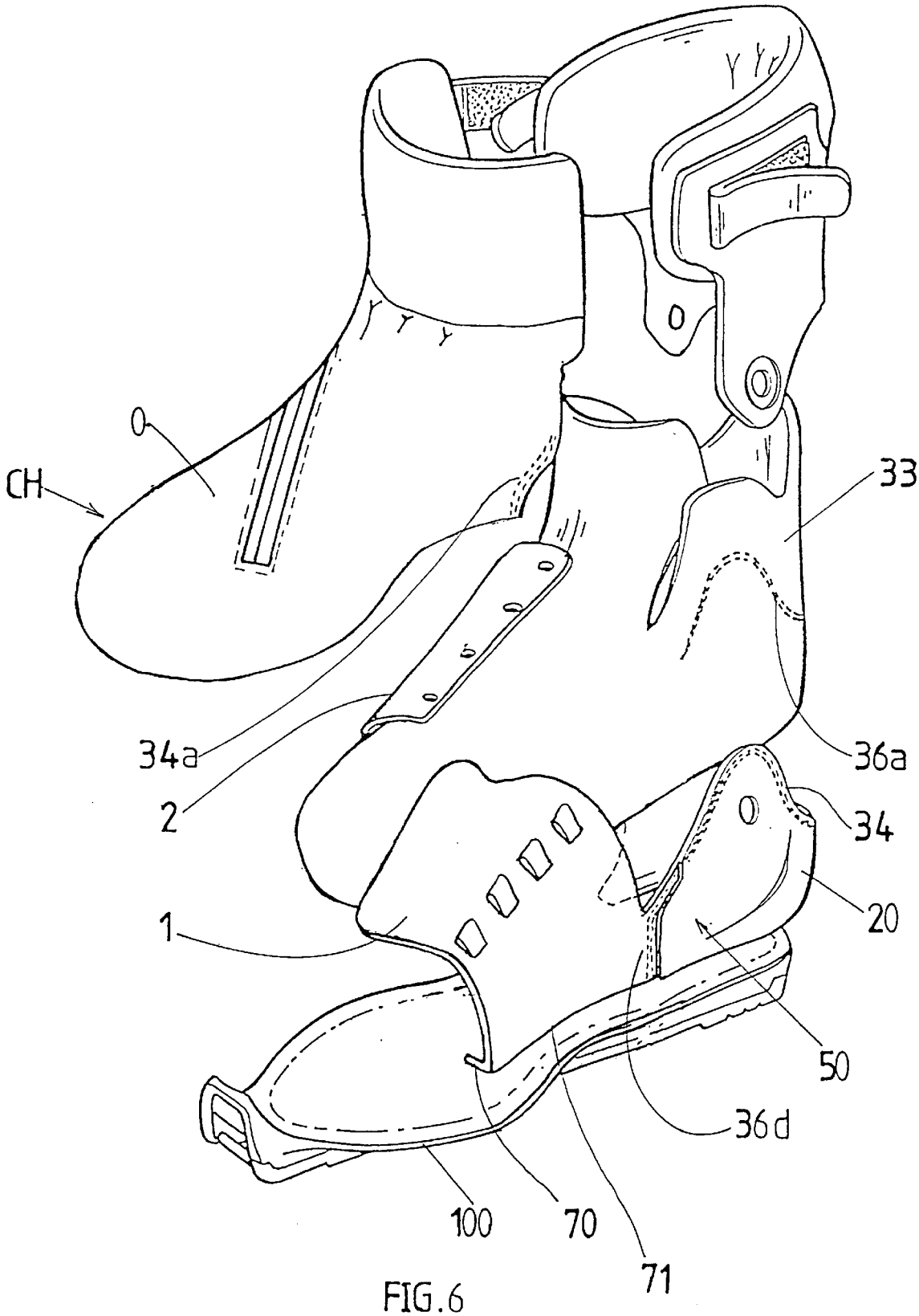
FIG. 6 schematically shows an exploded perspective front view of a cross-country ski boot equipped with the tightening device according to an alternative of the third embodiment.

FIG. 6 shows an article of footwear CH adapted to cross-country skiing, and in particular to skating. This article of footwear CH is also adapted to be fixed on a plate, or to be mounted so as to be journalled on the plate for in-line roller skating and ice skating. This alternative embodiment differs mainly from the embodiment shown in FIG. 5 in that the heel stiffener 20 and the lower flap 1 are no longer two distinct pieces but form a single piece designated here as the holding piece 50.

Indeed, the lower flap 1 extends rearwardly in a continuous manner by merging with the heel stiffener 20. However, the lower flap 1 is positioned beneath the upper O to form together with the upper flap 2, a tightening device inside the article of footwear CH, and the heel stiffener 20 remains outside the article of footwear CH. To obtain this result, the upper O includes appropriate fixing means, such as a seam 34*a* that fixes the upper O to the outside of the lower flap 1, in the area of a stitching zone 36*d*. Similarly, the heel stiffener 20 includes appropriate fixing means such as seams 34 which fix the heel stiffener 20 to the outside of the article of footwear CH, in the area of a stitching zone 36*a*. The heel stiffener 20 here is fixed to the comfort sock 33 by the seam 34. Once the article of footwear CH has been assembled, the seams 34 and 34*a* can be advantageously aligned.

Moreover, the holding piece 50 varies in thickness, in the vicinity of the stitching zone 36*d* which makes it possible to demarcate the heel stiffener 20 whose thickness is greater than the thickness of the lower flap 1. The thickness of the heel stiffener 20 is substantially equal to the thickness of the flap 1, in the area of the stitching zone 36*d* to which the thickness of the upper O is added. Thus, the upper O brushes the heel stiffener 20 in the area of the stitching zone 36*d*, and the article of footwear CH therefore does not have hooking points in this area, in particular between the two boots, which could be dangerous for the user during the practice of the sport. The holding piece 50 advantageously includes a return 70 that extends substantially horizontally from the upper edge 71 toward the interior of the article of footwear CH. This return facilitates the fixing of the holding piece 50 on the sole 100 by known means such as seams or glue.

Figure 7:
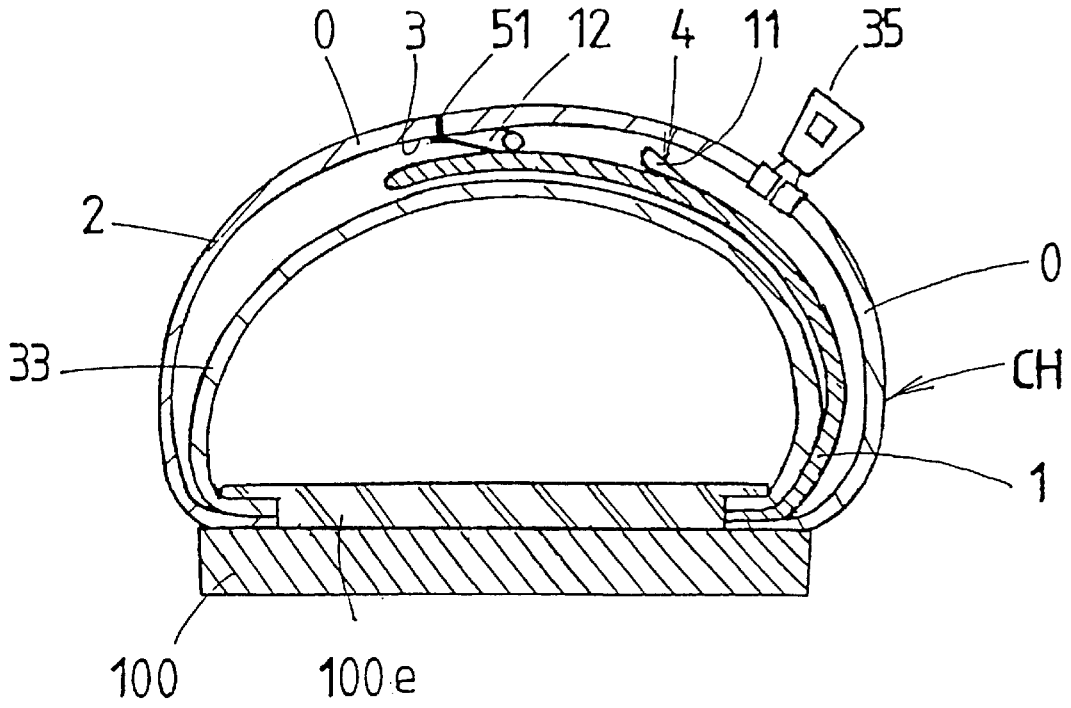
FIGS. 7 and 8 schematically show a transverse cross-section with respect to the footwear, in the area of the tightening device, of a sports boot equipped with the tightening device according to the fourth embodiment.

FIG. 7 shows a cross-section of an article footwear CH in the area of the lower flap 1 of the present tightening device. In the embodiment currently shown, the upper flap 2 is integral with the upper O of the article of footwear CH, and the lower flap 1 is positioned within the upper O. The present device therefore produces an internal half-tightening, i.e., an internal tightening with a single flap. The article of footwear CH includes a comfort sock 33 adapted to be in contact with the foot, which is overlaid by the lower flap 1. The lower flap 1 is covered by the upper O which includes an appropriate closure mechanism 35, in particular a zipper-type closure. The upper O, the lower flap 1, and possibly the comfort sock 33 are fixed to the sole 100 by known methods, such as the use of an insole 100*e*. For example, the elements O, 1, 33 are fixed on the lower surface of the insole 100*e*, then the whole thing is fixed to the sole 100.

The tightening mechanism 4, which is shown without the link for more clarity, includes at least one anchor 11, which is fixed on the top of the lower flap 1, and at least one anchor 12, which is fixed on the inner surface 3 of the upper flap 2, this inner surface 3 being opposite the lower flap 1. Similarly, the anchor 12 is plumb with the lower flap 1 so that it does not hinder during the tightening phase of the tightening mechanism 4. Moreover, the rigidity of the lower flap 1 makes it possible to distribute the hard spot defined by the anchor 12 which is pressed against the flap 1 by the upper O and its closure mechanism 35. However, the anchor 12 can advantageously be a strap in order to be as thin as possible and can be advantageously fixed to the upper O by seams 51.

Figure 8:
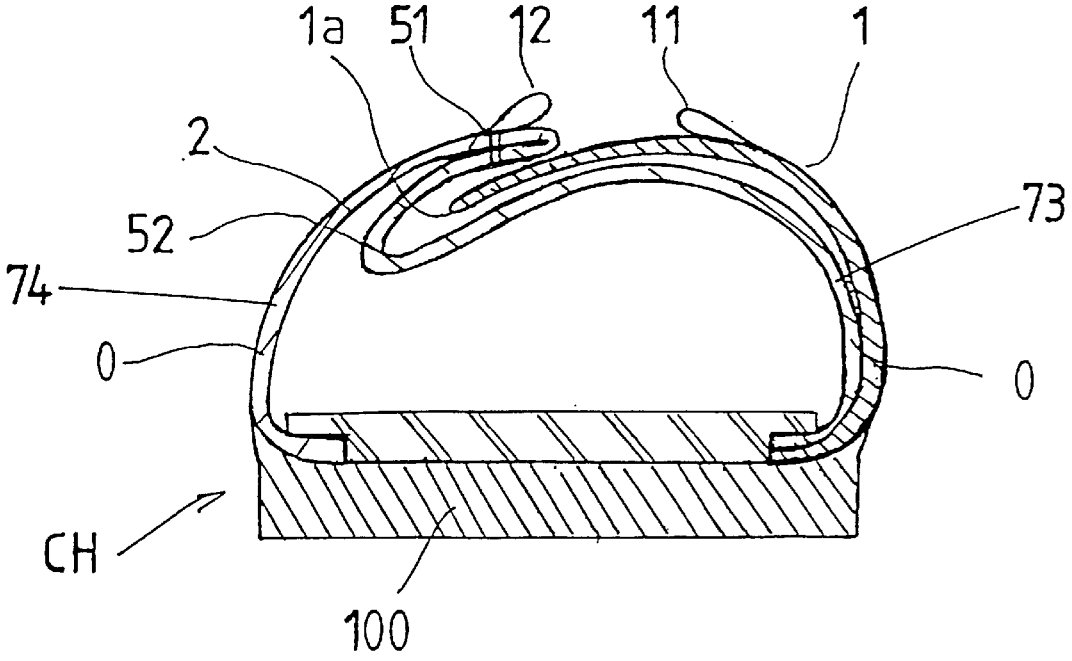

FIG. 8 shows a cross-section of a variation of a previously described embodiment. The upper flap 2 is still integral with the upper O of the article of footwear CH, but the lower flap 1 is outside the upper O so as to constitute an external half-tightening, i.e., an external tightening with a single flap. The upper O and the lower flap 1 are fixed to the sole 100 in a known and previously described manner. However, the anchor 12 of the tightening mechanism 73, whose link is not shown, is positioned on the top of the upper flap 2. The portion of the upper O, which is positioned beneath the flap 1, includes a return 52 which makes it possible to protect the foot from the contact with the edge 1*a* of the flap 1, and which connects to the other portion 74 of the upper O including the upper flap 2. The junction between the return 52 and the flap 2, positioned next to the anchor 12, can be obtained in particular by a sharp curvature of the upper O maintained by the fixing mechanism 51 of the anchor 12 which can advantageously extend through the two thicknesses of the upper O. Respecting this constructional arrangement makes it possible to ensure a good imperviousness of the upper O against external attacks such as rain or snow.

Figure 9:
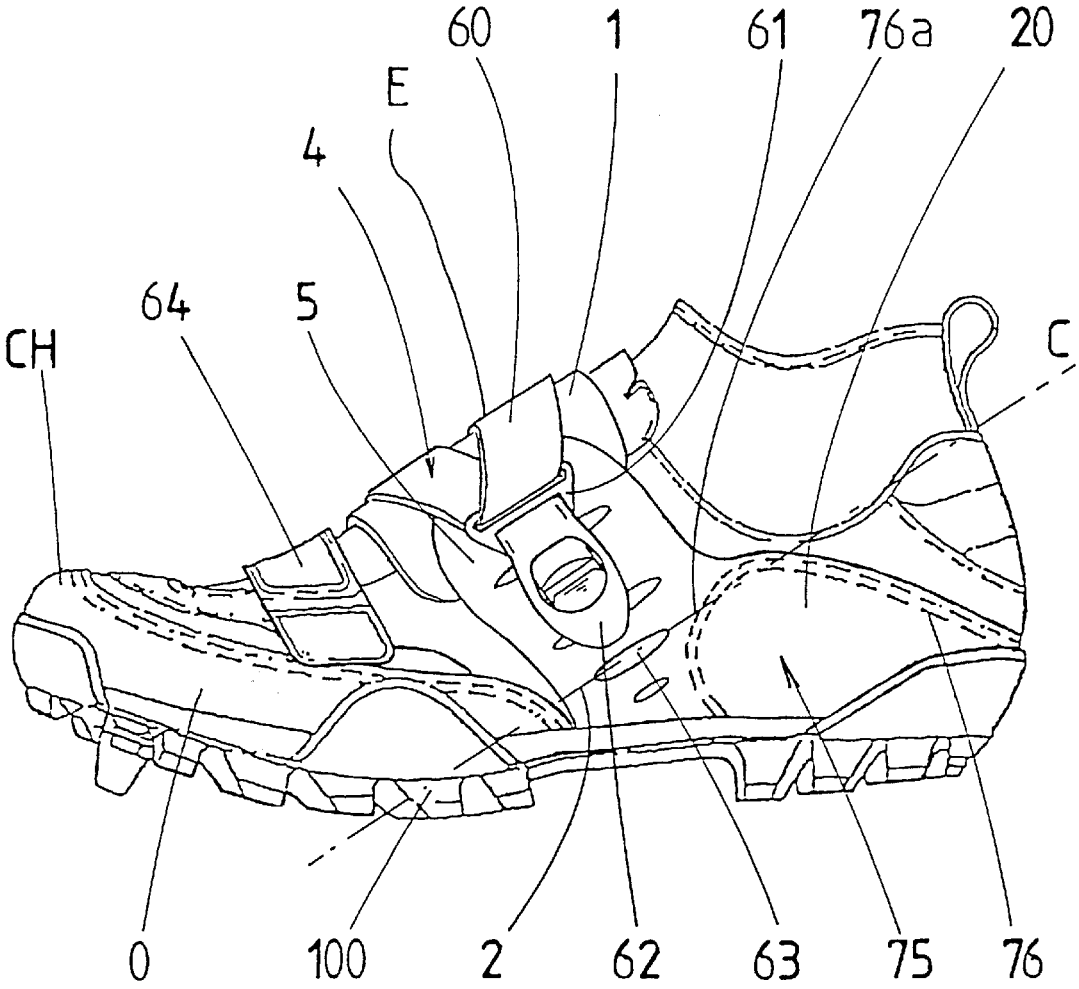
FIG. 9 schematically shows a side view of biking shoe equipped with the tightening device according to a third alternative of the second embodiment.

In FIG. 9, the article of footwear CH shown is a biking shoe adapted in particular, but in a non-limiting manner, to all-terrain biking. The present shoe CH advantageously cooperates with a bike pedal in order to optimize the pedaling power by pulling the pedal upward. When the pedal is hooked to the sole 100, the tractional force of the foot is reflected on the top of the foot, especially in the area of the instep. The rigidity of the lower flap 1, which is positioned on the top of the foot, also makes it possible to limit the upward deformations of the upper O of the article of footwear CH. Thus, the lower flap 1 also plays the role of distributing tractional forces on the top of the foot.

In the preferred embodiment shown in FIG. 9, the lower flap 1 is positioned on the instep and on the medial side of the foot. The upper flap 2 is brought closer to the lower flap 1 by a tightening mechanism 4 which preferably includes a strap 60 whose width is applied against the lower flap 1. The strap 60 is fixed at its ends either to the lower flap 1, or to the upper O, or yet to the sole 100 at two distinct points on the medial side of the article of footwear CH, and passes in a guide 61 that takes support on the upper flap 2 in the area of the overlapping zone 5. The guide 61 is connected to a closure and/or adjusting system, such as a buckle 62, which is fixed to the upper flap 2.

The tightening mechanism 4 can be different, and in particular, but in a non-limiting manner, can include a return directly fixed to the upper flap 2. The adjusting and closing function is then carried on the strap 60, for example in the connection zone of one of the ends of the strap 60, on the medial side of the footwear.

FIG. 9 also shows an alternative construction of the upper flap 2. The upper flap 2 extends rearwardly by merging with a heel stiffener 20 to form a single holding piece 75. The heel stiffener 20 is fixed to the outside of the upper O by appropriate means, such as a stitched seam 76 that extends substantially along a portion of the periphery of the heel stiffener 20, and which is extended by a stitched seam 76*a* separating the portion of the upper flap 2 from the portion of the heel stiffener 20. Thus, the upper flap 2 is fixed to the upper O only by its base and by the seam 76*a* in order to ensure a better tightening of the footwear. Furthermore, if the holding piece 75 is made out of a single material, for example a thermoplastic material, the flexibility of the upper flap 2 can be advantageously obtained by at least one recess 63. This recess 63, which can be a through recess, or can include a reduction in the thickness of the upper flap 2, is oriented along a direction C that is substantially parallel to the upper edge E of the instep. This direction corresponds approximately to the preferred bending axis of the upper flap 2 to envelop the foot.

The flexibility of the upper flap 2 in relation to the lower flap 1 can be obtained by a shorter width of the upper flap 2 in relation to the lower flap 1. Thus, the flaps 1, 2 and the heel stiffener 20 can be obtained with the same material, and possibly constitute a unitary piece that surrounds the heel and extends forwardly along the upper O by covering the sides and the top of the instep.

The tightening device can also be completed by a complementary tightening mechanism 64. In FIG. 9, this complementary tightening mechanism 64 is independent of the present tightening device, and is of the self-griping type (a hook-and-loop fastener, e.g.) and is positioned on the top of the foot, in the area of the metatarsophalangeal joint of the foot.

The present invention is not limited to the embodiments described hereinabove, which are only provided for guidance, but encompasses all of the combinations of the embodiments and alternative constructions, in particular relative to the lower flap and the upper flap described in the various embodiments, and also encompasses all similar or equivalent embodiments.

The present invention also encompasses the boots equipped with the present tightening device.

What is claimed is:

1. A tightening device, adapted to equip an article of footwear including a sole, said tightening device comprising:

a lower flap;

an upper flap including an overlapping zone which partially covers the lower flap;

a tightening mechanism comprising at least one anchor positioned on each of the flaps;

the upper flap being more flexible than the lower flap.

2. A tightening device according to claim 1, wherein the upper flap is made of more flexible material(s) than that of the lower flap.

3. A tightening device according to claim 1, wherein the upper flap is thinner than the lower flap.

4. A tightening device according to claim 1, wherein the upper flap includes recesses making it possible to soften and ventilate said flap.

5. A tightening device according to claim 1, wherein the one anchor on the upper flap is positioned in the overlapping zone.

6. A tightening device according to claim 1, wherein the lower flap extends rearwardly by obtaining a heel stiffener.

7. A tightening device according to claim 1, wherein the one anchor positioned on the lower flap is positioned beyond the overlapping zone.

8. A tightening device according to claim 1, wherein the at least one anchor positioned on each of the flaps are lace guides, and wherein the tightening device further comprises a lace guided by the lace guides.

9. An article of footwear equipped with the tightening device according to claim 1.

10. An article of footwear according to claim 9, wherein the article of footwear includes an upper, and wherein the lower flap and the upper flap are positioned within the upper, thus constituting a tightening inside the article of footwear.

11. An article of footwear according to claim 9, wherein the article of footwear includes an upper, and wherein the upper flap is integral with the upper.

12. An article of footwear according to claim 9, wherein the article of footwear includes a sole, and wherein the lower flap includes fixing means adapted to affix the lower flap to the sole.

13. An article of footwear according to claim 9, wherein the lower flap extends over an uppermost portion of an instep area.

14. An article of footwear according to claim 9, wherein the lower flap and the upper flap are positioned rearward of a metatarsophalangeal joint area.

15. An article of footwear according to claim 14, wherein the lower flap and the upper flap are positioned forward of an area of a malleolus of an ankle joint.

16. An article of footwear comprising:

an upper;

a sole;

a tightening device comprising:

a lower flap;

an upper flap including an overlapping zone which partially covers the lower flap;

a tightening mechanism comprising at least one anchor positioned on each of the flaps;

the upper flap being more flexible than the lower flap;

the lower flap and the upper flap being positioned external of the upper, thus constituting a tightening outside of the article of footwear.

17. An article of footwear comprising:

a tightening device comprising:

a lower flap;

an upper flap including an overlapping zone, the overlapping zone partially covering the lower flap;

the upper flap being more flexible than the lower flap;

a tightening mechanism comprising at least one anchor attached to the lower flap and at least one anchor attached to the upper flap;

the lower flap underlying the upper flap beyond the one anchor attached to the lower flap.

18. An article of footwear according to claim 17, wherein the upper flap is more flexible than the lower flap by being made of material(s) more flexible than material(s) of the lower flap.

19. An article of footwear according to claim 17, wherein the upper flap is more flexible than the lower flap by being thinner than the lower flap.

20. An article of footwear according to claim 17, wherein the upper flap the upper flap is more flexible than the lower flap by including recesses, said recesses serving to soften and ventilate the upper flap.

21. An article of footwear according to claim 17, wherein the one anchor on the upper flap is positioned in the overlapping zone.

22. An article of footwear according to claim 17, wherein the at least one anchor positioned on each of the flaps are lace guides, and wherein the tightening device further comprises a lace guided by the lace guides.

23. An article of footwear according to claim 17, wherein the lower flap extends rearwardly to a heel stiffener.

24. An article of footwear according to claim 17, wherein the article of footwear includes an upper, and wherein the lower flap and the upper flap are positioned within the upper, thus constituting a tightening inside the article of footwear.

25. An article of footwear according to claim 17, wherein the article of footwear includes an upper, and wherein the upper flap is integral with the upper.

26. An article of footwear according to claim 17, wherein the article of footwear includes a sole, and wherein the lower flap is made of a material extending to and fixed to the sole.

27. An article of footwear according to claim 17, wherein the lower flap extends over an uppermost area of an instep area.

28. An article of footwear comprising:

an upper;

a tightening device comprising:

a lower flap;

an upper flap including an overlapping zone, the overlapping zone partially covering the lower flap;

the upper flap being more flexible than the lower flap;

a tightening mechanism comprising at least one anchor attached to the lower flap and at least one anchor attached to the upper flap;

the lower flap underlying the upper flap beyond the one anchor attached to the lower flap;

the lower flap and the upper flap being positioned external of the upper, thus constituting a tightening outside of the article of footwear.

29. An article of footwear comprising:

a tightening device comprising:

a lower flap;

an upper flap including an overlapping zone, the overlapping zone partially covering the lower flap;

the upper flap being more flexible than the lower flap;

a tightening mechanism comprising at least one anchor attached to the lower flap and at least one anchor attached to the upper flap;

the one anchor attached to the lower flap being transversely spaced apart from the one anchor attached to the upper flap.

30. An article of footwear comprising:

an upper;

a tightening device comprising:

a lower flap;

an upper flap including an overlapping zone, the overlapping zone partially covering the lower flap;

the upper flap being more flexible than the lower flap;

a tightening mechanism comprising at least one anchor attached to the lower flap and at least one anchor attached to the upper flap;

at least one of the upper and lower flaps being distinct from and overlying or underlying a portion of the upper, whereby both the upper and lower flaps overlie the portion of the upper.

31. An article of footwear comprising:

an upper;

a tightening device comprising:

a lower flap;

an upper flap including an overlapping zone, the overlapping zone partially covering the lower flap;

the upper flap being more flexible than the lower flap;

a tightening mechanism comprising at least one anchor attached to the lower flap and at least one anchor attached to the upper flap;

at least one of the upper and lower flaps being distinct from and overlying or underlying a portion of the upper.

32. An article of footwear according to claim 30, wherein both the upper and lower flaps underlie the portion of the upper.

33. An article of footwear according to claim 30, further comprising a sole, and wherein said one of the upper and lower flaps comprises a material attached to the sole.

34. An article of footwear according to claim 30, wherein the upper flap is more flexible than the lower flap by being made of material(s) more flexible than material(s) of the lower flap.

35. An article of footwear according to claim 30, wherein the upper flap is more flexible than the lower flap by being thinner than the lower flap.

36. An article of footwear according to claim 30, wherein the upper flap the upper flap is more flexible than the lower flap by including recesses, said recesses serving to soften and ventilate the upper flap.

37. An article of footwear according to claim 30, wherein the one anchor on the upper flap is positioned in the overlapping zone.

38. An article of footwear according to claim 30, wherein the at least one anchor positioned on each of the flaps are lace guides, and wherein the tightening device further comprises a lace guided by the lace guides.

39. An article of footwear according to claim 30, wherein the lower flap extends rearwardly to a heel stiffener.

40. An article of footwear according to claim 30, wherein the lower flap extends over an uppermost portion of an instep area.

* * * * *